United States Patent [19]

Uno et al.

[11] Patent Number: 4,508,527

[45] Date of Patent: Apr. 2, 1985

[54] METHOD AND APPARATUS FOR QUANTITATIVELY DIVIDING ZIGZAG FOLDED SHEET OF PAPER

[76] Inventors: Tadao Uno, 1-81, Matsugaoka 1-chome, Chigasaki-shi, Kanagawa-ken; Hiroshi Uno, 3189-7, Samukawa-cho Okada, Kohza-gun, Kanagawa-ken, both of Japan

[21] Appl. No.: 531,469

[22] Filed: Sep. 12, 1983

[30] Foreign Application Priority Data

Sep. 20, 1982 [JP] Japan ..... 57-163694

[51] Int. Cl.[3] ..... B65H 45/20; B65H 45/28

[52] U.S. Cl. ..... 493/357; 225/103; 270/40; 493/414

[58] Field of Search ..... 493/356, 357, 414, 413, 493/411, 410; 225/103; 270/21.1, 40; 400/621; 83/660

[56] References Cited

U.S. PATENT DOCUMENTS

| | | | |
|---|---|---|---|
| 1,858,073 | 5/1932 | Cole | 493/414 |
| 4,205,836 | 6/1980 | Nystrand | 493/357 |
| 4,401,428 | 8/1983 | Thomas et al. | 493/411 X |

FOREIGN PATENT DOCUMENTS

| | | | |
|---|---|---|---|
| 55-140454 | 11/1980 | Japan | 493/411 |

*Primary Examiner*—Francis S. Husar
*Assistant Examiner*—Steven B. Katz
*Attorney, Agent, or Firm*—Wenderoth, Lind & Ponack

[57] ABSTRACT

A method for quantitatively dividing a zigzag folded sheet of paper comprises continuously folding a sheet of paper to obtain a zigzag folded sheet of paper having a plurality of divisions connected to one another, continuously accumulating the divisions one on top of another, allowing a separator with a cutting edge to be inserted, when the continuous accumulation constitutes a first unit composed of a prescribed number of divisions, between the uppermost division of the first unit and the division connected to the uppermost division and becoming the lowermost division of a second unit to be subsequently obtained, thereby partitioning the first unit, allowing the first unit and the separator to descend to accumulate the divisions which will constitute the subsequent unit on the separator and allow the separator to advance immediately before the fold between the aforementioned uppermost and lowermost divisions, and allowing the cutting edge to advance away from the separator to cut off the fold.

3 Claims, 12 Drawing Figures

METHOD AND APPARATUS FOR QUANTITATIVELY DIVIDING ZIGZAG FOLDED SHEET OF PAPER

BACKGROUND OF THE INVENTION

1. Field of the Invention

The present invention relates to a method for quantitatively dividing a zigzag folded sheet of paper and also to an apparatus for carrying out the method.

2. Description of the Prior Art

A sheet of paper folded in a zigzagged form is used such as output displaying paper of a computer, for example. This kind of paper has a plurality of linear perforations formed therein in the direction of its width and disposed at regular intervals in its lengthwise direction, and is required to be continuously folded at the positions of the linear perforations so that the divisions formed between the adjacent linear perforations are successively piled up one on top of another is a zigzagged form and to be divided by cutting off the folds into units each composed of a prescribed number of divisions.

The step of continuously folding a sheet of paper to allow the divisions to be piled up one on top of another in a zigzagged form has already been mechanically automatically carried out. However, the step of dividing the folded and piled sheet into units each composed of a prescribed number of divisions by cutting treatment has been effected separately. In order to obtain the aforementioned units, therefore, it has heretofore been required to count a prescribed number of divisions constituting a unit and divide the sheet into a number of units after the folding step and to longitudinally accumulate the units so that the folds may be in alignment with one another. Thus, the conventional work for quantitative dividing requires much time and labor and is very inefficient.

SUMMARY OF THE INVENTION

The present invention has been established in order to eliminate the aforementioned drawbacks.

One object of the present invention is to provide a method for quantitatively dividing a zigzag folded sheet of paper, which is capable of automatically cutting and dividing the sheet of paper into units during the course of the sheet being folded at the positions of the linear perforations and having the divisions piled up one on top of another.

Another object of the present invention is to provide an apparatus adapted to be used in working the aforementioned method.

To attain the objects described above, according to the present invention, there is provided a method for quantitatively dividing a zigzag folded sheet of paper, comprising the steps of continuously folding a sheet of paper to obtain a zigzag folded sheet of paper having a plurality of divisions connected to one another, continuously accumulating the divisions one on top of another, allowing a separator with a cutting edge to be inserted, when the continuous accumulation constitutes a first unit composed of a prescribed number of divisions, between the uppermost division of the first unit and the division connected to the uppermost division and becoming the lowermost division of a second unit to be subsequently obtained, thereby partitioning the first unit, allowing the first unit and the separator to descend to accumulate the divisions which will constitute the subsequent unit on the separator and allow the separator to advance immediately before the fold between the aforementioned uppermost and lowermost divisions, and allowing the cutting edge to advance away from the separator to cut off the fold, and also provided a separator used for the apparatus for carrying out the method, which separator comprises a main separator formed of a thin plate having its forward end provided with a corrugated portion, and an auxiliary separator/cutting edge having its backward end provided with a corrugated portion which conforms to the corrugated portion of the main separator and having its forward end provided with the cutting edge, the separator as a whole being allowed to advance or retreat by cylinders disposed on the opposite sides of the main separator, the auxiliary separator/cutting edge being allowed to advance or retreat by other cylinders disposed on the main separator.

The aforementioned objects and other objects, characteristic features and advantages of the present invention will become apparent from the following description made in detail with reference to the accompanying drawings.

DESCRIPTION OF THE PREFERRED EMBODIMENT

Figure 1:
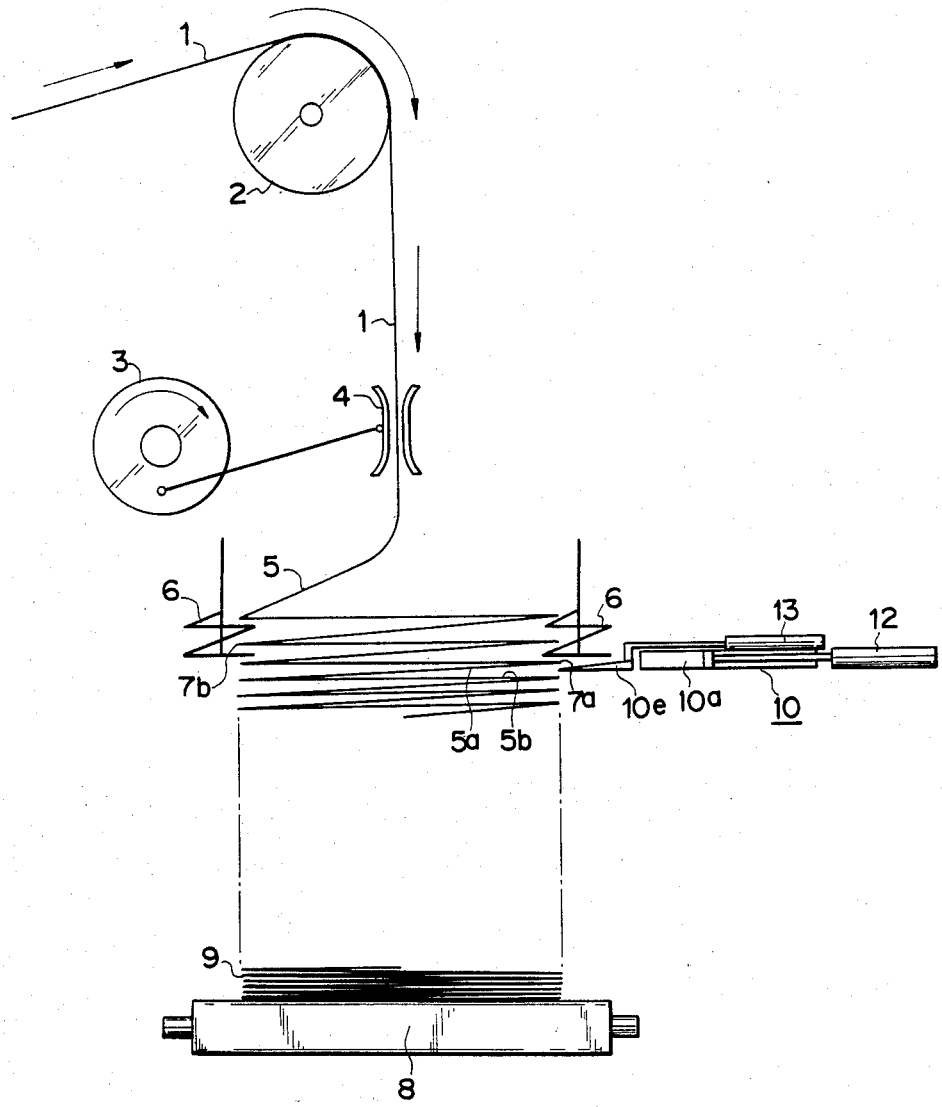
FIG. 1 is a schematic side view showing one embodiment of the apparatus for carrying out the method of the present invention.
Figure 2:
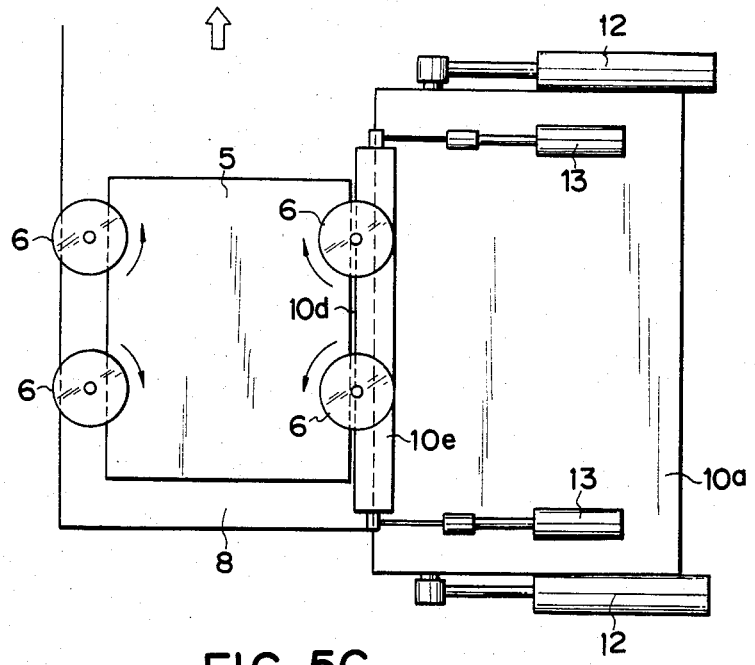
FIG. 2 is a plan view of the embodiment.

The present invention will be described in detail with reference to the illustrated embodiment.

Denoted by numeral 1 is a sheet of paper having a plurality of linear perforations 7. This sheet 1 is continuously transferred vertically through a roller 2. The portion of the sheet transferred vertically as folded at the positions of the linear perforations 7 in a zigzagged form by operating a crank mechanism 3 to allow a pair of distributing and folding plates 4 to be continuously swung alternately in the rightward and leftward directions. The zigzag folded paper 5 thus obtained is supplied to a fold processing portion comprising at least one pair of opposed spiral rotors 6 which are disposed below the pair of distributing and folding plates 4. The opposed spiral rotors 6, while retaining the portions of the linear perforations 7 at both ends of the zigzag folded paper 5, draw out the zigzag folded paper downwardly with the linear performations 7 serving as folds 7*a* and 7*b* onto a conveyor 8 which descends in proportion to the amount of the zigzag folded paper drawn out. The zigzag folded paper 5 thus accumulated on the conveyor forms longitudinally accumulated paper 9.

Numeral 10 stands for a separator comprising a main separator 10*a* and an auxiliary separator/cutting edge 10*e* which serves both as an auxiliary separator and as a cutting edge. This separator 10 is disposed immediately below one of the pair of opposed spiral rotors 6 so that it may be inserted between a division 5*a* of the zigzag folded paper 5 drawn out by the spiral rotors 6 and retained immediately before descending from the spiral rotors 6 and a division 5*b* of the zigzag folded paper 5 connected to the division 5*a* and retained immediately after descending from the spiral rotors 6, from the side of a fold 7*a* at one end of the division 5*b*. Reference numeral 12 denotes cylinders disposed on the opposite sides of the separator 10 for allowing the separator 10 as a whole to advance or retreat relative to the zigzag folded paper 5, and 13 cylinders disposed on the separator 10 for allowing the auxiliary separator/cutting edge 10*e* alone to advance or retreat relative to the zigzag folded paper 5. By these cylinders 12 and 13, the separator 10 is controlled to intervene between the divisions of the zigzag folded paper such as when the crank mechanism 3 has been rotated prescribed times.

Figure 3A:
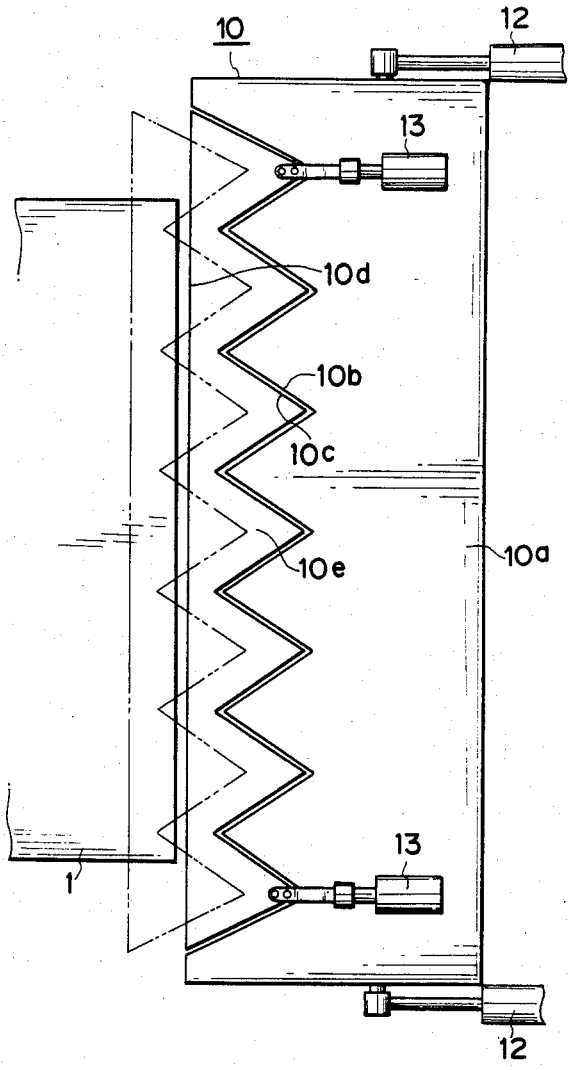
FIGS. 3A and 3B are a plan view and a cross-sectional view respectively showing a separator used in the embodiment.
Figure 4:
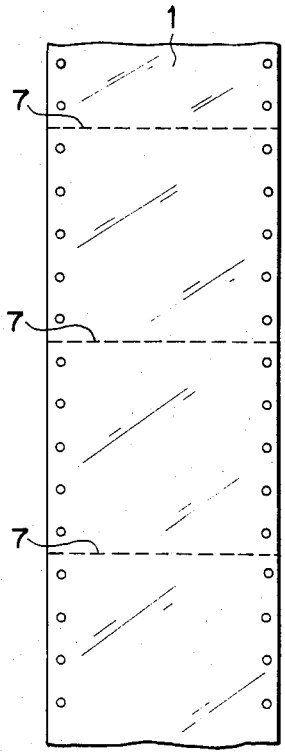
FIG. 4 is a plan view illustrating part of a sheet of paper used in the embodiment.
Figure 3B:
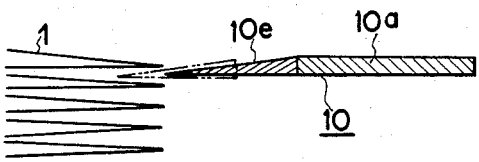

One example of the separator 10 is illustrated in FIG. 3. It comprises the main separator 10*a* formed of a thin plate having its forward end provided with a corrugated portion 10*b* such as a portion having saw teeth or rectangular teeth, and an auxiliary separator/cutting edge 10*e* having its backward end provided with a corrugated portion 10*c* which conforms to the corrugated portion 10*b* of the main separator 10*a* and having its forward end provided with cutting edge 10*d*.

With the construction as described above, the sheet of paper 1 with linear perforations, which is continuously fed in the vertical direction, is zigzag folded at the positions of the linear perforations 7 by continuously shifting the distributing and folding plates 4 alternately in the rightward and leftward directions by means of the crank mechanism 3. The zigzag folded paper 5 thus obtained is supplied to the spiral rotors 6, continuously drawn out downwardly with the folds 7*a* and 7*b* given to the paper at the positions of the linear perforations 7 by the spiral rotors 6, and longitudinally accumulated on the conveyor 8. The conveyor 8 descends in accordance with the amount of the longitudinal accumulation to form the longitudinally accumulated paper 9 thereon. While the divisions of the zigzag folded paper are being successively accumulated on the conveyor 8, the zigzag folded paper is automatically cut and divided into units each composed of a prescribed number of divisions as described afterward.

The automatic step of cutting and dividing of the zigzag folded paper will be described with reference to FIGS. 5A through 5G.

Figure 5G:
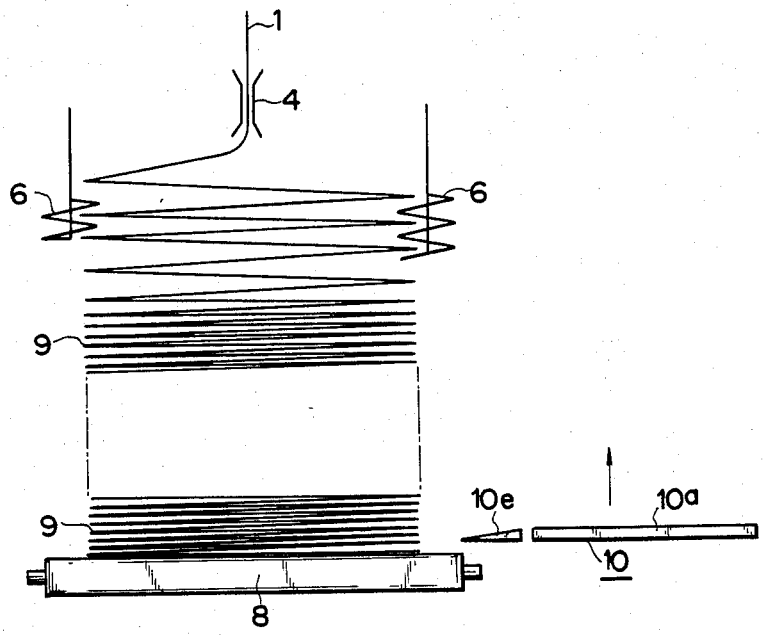
FIGS. 5A through 5G are explanatory views showing the steps of one embodiment of the method for quantitatively dividing a zigzag folded sheet of paper according to the present invention.
Figure 5A:
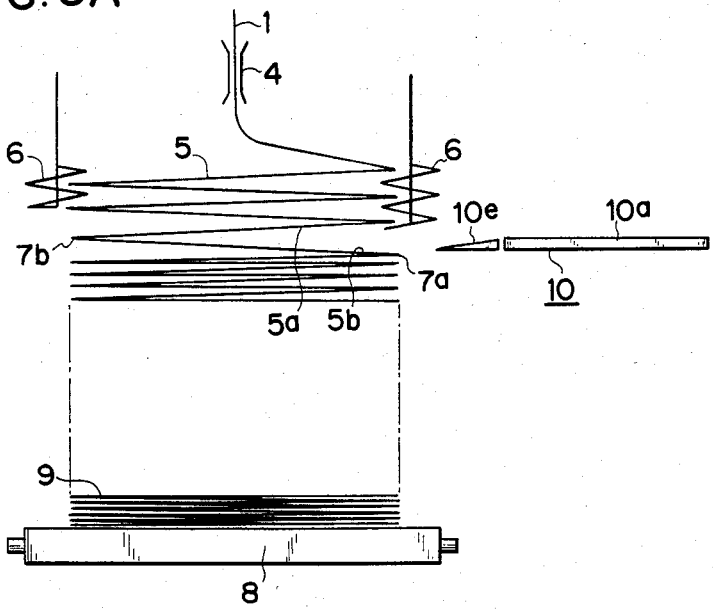
Figure 5B:
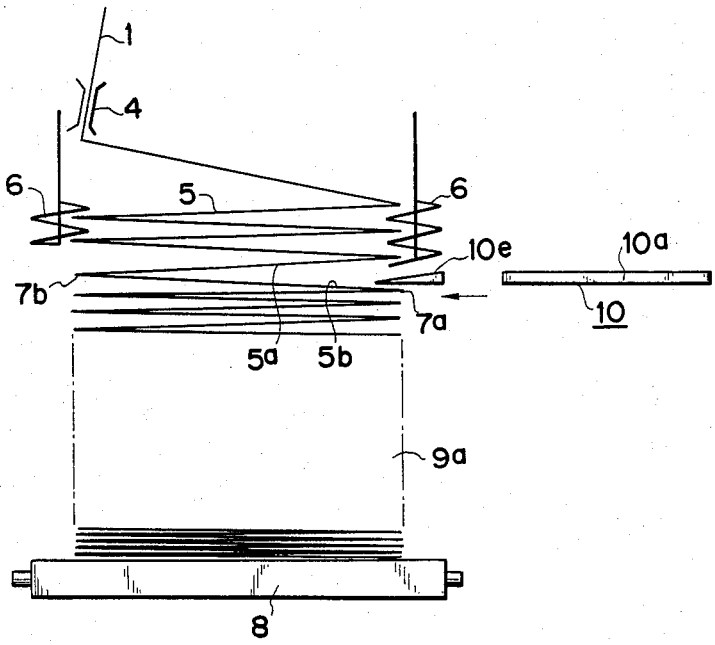
Figure 5C:
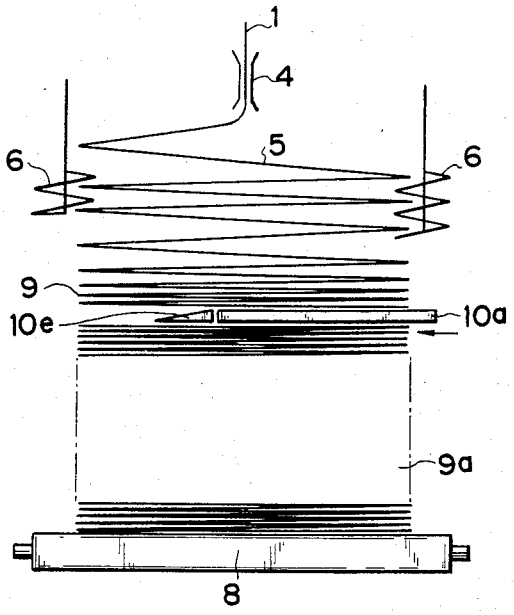
Figure 5D:
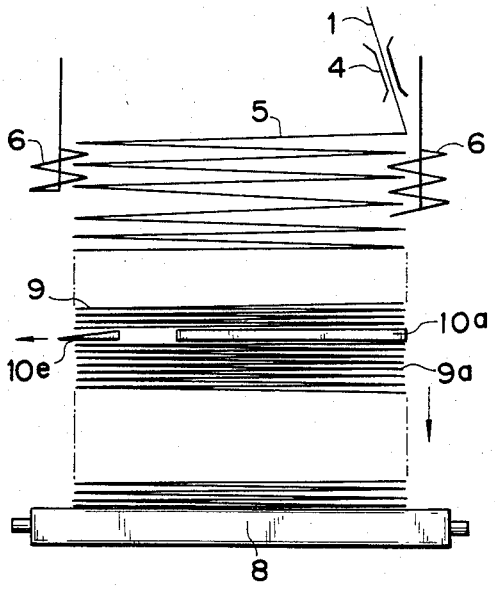
Figure 5E:
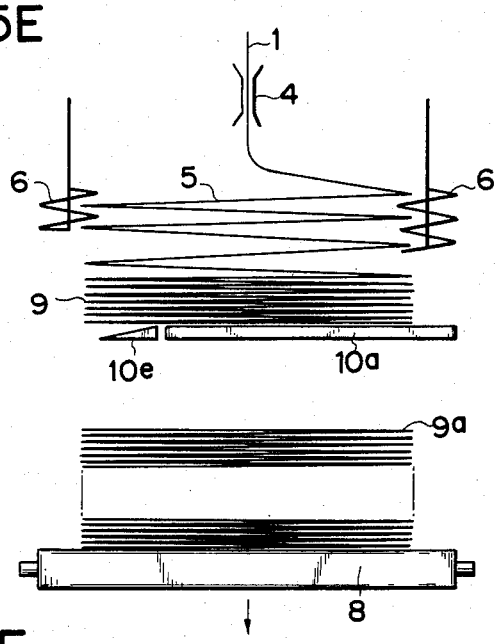
Figure 5F:
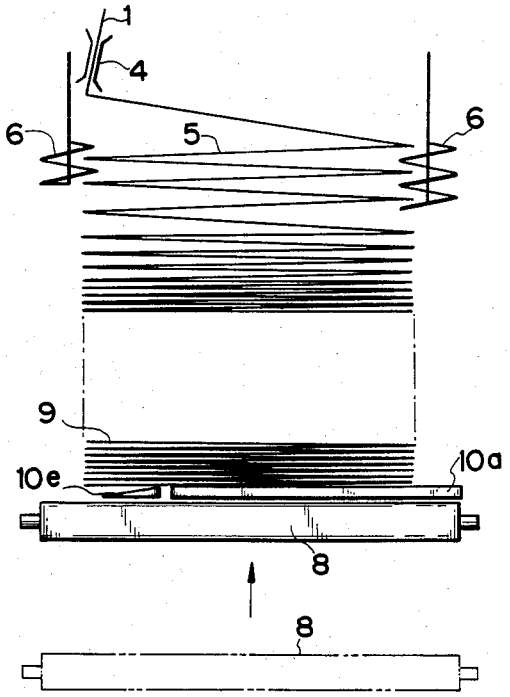

At the time that the accumulated paper 9 has not yet constituted a desired unit composed of a prescribed number of divisions, the separator 10 is disposed at a standby position immediately below the spiral rotor 6 as illustrated in FIG. 5A. Upon formation of a desired unit 9*a*, the leading end of the auxiliary separator/cutting edge 10*e* is inserted at a high speed between the uppermost division 5*b* of the unit 9*a* drawn out below the spiral rotors 6 and the lowermost division 5*a* of a unit to be subsequently formed, which lowermost division is connected to the uppermost division 5*b*, from the side of the fold 7*a* at one end of the uppermost division 5*b*, as illustrasted in FIG. 5B, thereby partitioning off the unit 9*a* of the zigzag folded paper. Subsequently, while the main separator 10*a* is allowed to descend in proportion to the descent of the longitudinally accumulated paper resulting from the descent of the conveyor 8 and the zigzag folded paper connected to the partitioned unit 9*a* is accumulated on the upper surface of the main separator 10*a*, the main separator 10*a* is moved, preferably at a low speed, to a position immediately before the fold 7*b* between the uppermost division of the unit 9*a* and the lowermost division of a unit to be subsequently formed and, during the time the main separator 10*a* reaches the position immediately beforew the fold 7*b*, the auxiliary separator cutting edge 10*e* is allowed to retreat to the original position relative to the main separator 10*a*, as illustrated in FIG. 5C. After the separator 10 has reached the position immediately before the fold 7*b*, the auxiliary separator/cutting edge 10*e* is allowed to advance away from the main separator 10*a* to thereby cut the fold 7*b* as illustrated in FIG. 5D. Immediately thereafter, the auxiliary separator/cutting edge 10*e* is allowed to retreat to the leading end of the main separator 10*a* as illustrated in FIG. 5E and, at the same time, the conveyor 8 is allowed to descend to thereby separate the uppermost division of the unit 9*a* from the lower surface of the separator 10. The unit 9*a* is then removed from the longitudinal accumulation position by the conveyor and thereafter the conveyor is moved to the longitudinal accumulation position and allowed to ascend to a position immediately below the separator 10 as shown in FIG. 5F., In synchronism with the ascent of the conveyor, the separator 10 is allowed to retreat as shown in FIG. 5G to allow the paper having not yet constituted a subsequent unit composed of a prescribed number of divisions but having been accumulated on the upper surface of the separator 10 to be transferred onto the conveyor 10. Upon completion of this transfer, the separator 10 is allowed to ascend to the standby position as shown in FIG. 5A and is ready for effecting the subsequent dividing procedure.

According to the present invewntion, as described above, since the comparator with the cutting edge is inserted into a relatively large space formed between the divisions of the zigzag folded paper immediately below the fold processing portion while the divisions of the zigzag folded paper are continuously accumulated longitudinally, units each composed of a prescribed number of divisions can precisely be separated continuously from the zigzag folded and accumulated paper during the proceeding of the continuous folding in a zigzagged form and continuous accumulation in the longitudinal direction, by interposing the separator between the uppermost division of a first unit and the lowermost division of a subsequent unit connected to the uppermost division of the first unit, partitioning of the first unit can be carried out while the divisions constituting the subsequent unit can be accumulated on the upper surface of the separator and, at the same time, the step of cutting and dividing the unit partitioned under the separator off and from the subsequent unit having its component divisions accumulated on the separator can be carried out in parallel with all steps described above. Therefore, it is possible to automatically continuously obtain units each composed of a prescribed number of divisions. The quantitative dividing of a sheet of paper such as output displaying paper of a computer, which has heretofore been carried out either by a manual operation or by use of a semiautomatic machine, can automatically be effected continuously with high precision and high efficiency according to the present invention. Further, since the present invention has made it possible to reduce the time required for the cutting and dividing step and to simplify the mechanism and the mechanism and the manufacturing line, it is possible to cut down the wages and to reduce the manufacturing cost.

What is claimed is:

1. A method for quantitatively dividing a zigzag folded sheet of paper, which comprises the steps of:

continuously folding a sheet of paper, which has a plurality of linear perforations bored therein in its width direction and disposed at regular intervals in its lengthwise direction, at positions of said plurality of linear perforations to obtain a zigzag folded sheet of paper having a plurality of divisions connected to one another through said plurality of linear perforations, continuously accumulating said plurality of divisions one on top of another in the longitudinal direction below a fold processing portion by utilization of their own weights, inserting a separator carrying a cutting edge protruding beyond said separator and mounted for advancing or retreating movement relative to said separator, when the continuous longitudinal accumulation of said plurality of divisions constitutes a first unit composed of a prescribed number of divisions, between the uppermost division of said first unit drawn out immediately below said fold processing portion and the division directly connected to the uppermost division of said first unit and becoming the lowermost division of a second unit to be subsequently constituted from one end side of the zigzag folded sheet of paper, thereby partitioning said first unit of the zigzag folded sheet of paper, lowering both said first unit and said separator so as to thereby longitudinally accumulate on said separator the divisions continuously drawn out from said fold processing portion and, at the same time, advancing said separator immediately before a fold between the uppermost division of said first unit and the lowermost division of said second unit, which fold is disposed on the other side of the zigzag folded sheet of paper, and advancing said cutting edge relative to said separator to cut off said fold from the inside of said fold, whereby units each composed of a prescribed number of divisions are sequentially divided from the zigzag folded sheet of paper during the course of the continuous longitudinal accumulation of said plurality of divisions 2. A method for quantitatively dividing a zigzag folded sheet of paper according to claim 1, wherein the step of inserting includes advancing said cutting edge between the uppermost division of said first unit and the lowermost division of said second unit prior to the insertion of said separator therebetween to thereby serve as an auxiliary separator.

3. A method for quantitatively dividing a zigzag folded sheet of paper according to claim 1, including the steps of providing said separator comprised of a main separator formed of a thin plate having its forward end provided with a corrugated portion, and an auxiliary separator/ cutting edge having its backward end provided with a corrugated portion which conforms to said corrugated portion of said main separator and having its forward end provided with said cutting edge, advancing or retreating said separator as a whole by means of cylinders disposed on the opposite sides of said main separator, and advancing or retreating said auxiliary separator/cutting edge by means of other cylinders disposed on said main separator.

* * * * *